United States Patent [19]

Kitka

[11] 4,337,941

[45] Jul. 6, 1982

[54] BUILDING STRUCTURE

[75] Inventor: Zoltan Kitka, Surrey, Canada

[73] Assignee: Interplay Design Limited, White Rock, Canada

[21] Appl. No.: 152,342

[22] Filed: May 22, 1980

[51] Int. Cl.[3] ..... A63B 9/00

[52] U.S. Cl. ..... 272/113; 52/233; 403/172; 403/231

[58] Field of Search ..... 272/61-63, 272/93, 109-113, 144, 85; 52/233, 280, 281, 585, 592, 657; 46/19, 20; 297/442-451; 248/188; 403/172, 176, 231; D21/241-245; 256/60, 61, 65, 71

[56] References Cited

U.S. PATENT DOCUMENTS

| | | | |
|---|---|---|---|
| D. 250,784 | 1/1979 | Dieter et al. | 272/113 X |
| 1,322,203 | 11/1919 | Schroeder | 403/401 X |
| 1,655,701 | 1/1928 | Hyland et al. | 52/233 |
| 2,206,581 | 7/1940 | Shapiro | 272/113 |
| 3,719,358 | 3/1973 | Aaron | 272/113 |
| 3,969,871 | 7/1976 | Ewers | 272/113 X |

FOREIGN PATENT DOCUMENTS

| | | | |
|---|---|---|---|
| 377304 | 6/1923 | Fed. Rep. of Germany | 52/233 |
| 2237145 | 2/1974 | Fed. Rep. of Germany | 272/113 |
| 2249877 | 4/1974 | Fed. Rep. of Germany | 403/231 |
| 2549202 | 5/1976 | Fed. Rep. of Germany | 403/231 |
| 2621549 | 12/1976 | Fed. Rep. of Germany | 272/113 |
| 2242887 | 3/1975 | France | 403/231 |
| 9283 | of 1842 | United Kingdom | 403/231 |
| 189073 | 11/1922 | United Kingdom | 52/233 |

*Primary Examiner*—Richard J. Apley

*Attorney, Agent, or Firm*—Fulwider, Patton, Rieber, Lee & Utecht

[57] ABSTRACT

A building structure comprises upright members and mutually perpendicular horizontal members having notches at adjacent ends shaped to receive one of the upright members. Fasteners connect each of the horizontal members to the one upright member. The fasteners are elongate and extend from each horizontal member into the one upright member in the direction of the perpendicular horizontal members and towards the center of the one upright member. The fasteners are at an angle of substantially 45° with the horizontal members.

11 Claims, 3 Drawing Figures

BUILDING STRUCTURE

BACKGROUND OF THE INVENTION

The invention relates to a building structure having upright members and mutually perpendicular horizontal members connected together by elongate fasteners.

Earlier freestanding play structures are found in such United States Patents as U.S. Pat. Nos. 3,516,659 to Kleid and 2,954,977 to Durlacher. Most such structures, including children's play structures, piers, observation decks, and fence posts are typically sunk into the ground and secured by poured concrete, a costly and time consuming operation.

Connection devices for building structures are disclosed in U.S. Pat. Nos. 1,654,120 to Ewing, 1,655,701 to Hyland, 4,096,674 to Kollar, 2,208,671 to Gerber and 4,154,036 to Moss.

However, these earlier patents do not reveal a building structure, such as a child's play structure, essentially comprising a plurality of upright and horizontal members of timber or the like and having a desirably simple and rigid connection between the horizontal and upright members such that the structure can be freestanding.

SUMMARY OF THE INVENTION

According to the invention, a building structure comprises upright members and mutually perpendicular horizontal members having notches at adjacent ends shaped to receive a corner of one said upright member. The means for connecting each said horizontal member to said one upright member is an elongate fastener extending from said each horizontal member into the one upright member in the direction of the perpendicular horizontal members and towards the centre of the one upright member. The fastener is at an angle of substantially 45° with said each horizontal member.

The invention provides the advantage of an extremely rigid building structure formed by the upright members, horizontal members and the fasteners. The structure can be freestanding without the need of any cross bracing or special provisions such as concrete footings or fastenings to a floor. If desired, the entire structure can be made of standard timbers or logs and simple fasteners such as lag bolts or machine bolts and nuts. The invention is also applicable to structures made of steel components such as pipes, I-beams, channel beams or tubular beams, and other structural materials, such as plastics, acrylics and pre-cast concrete.

DESCRIPTION OF THE PREFERRED EMBODIMENT

Figure 1:
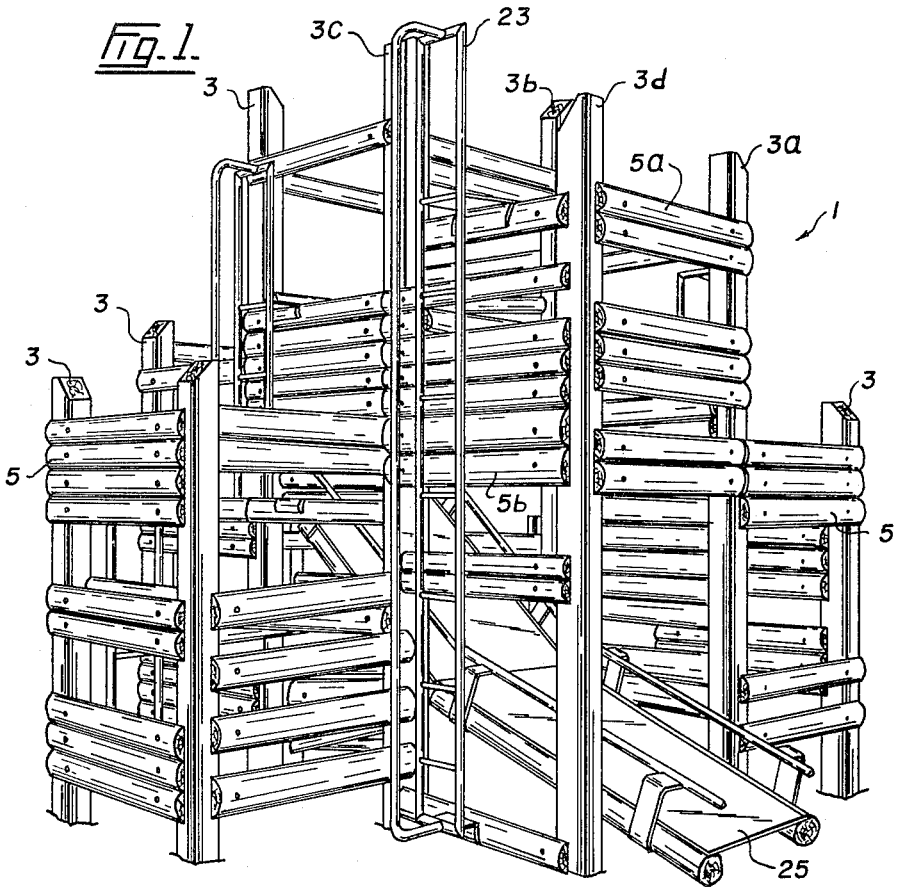
FIG. 1 is a perspective view of a child's play structure according to an embodiment of the invention.

FIG. 1 illustrates a child's play structure 1 having a plurality of upright members 3 which, in this case, are simple squared timbers. The upright members are in sets of four, for example members 3*a*, 3*b*, 3*c* and 3*d*, which are arranged at the corners of a horizontal square.

The upright members 3 are interconnected by a plurality of horizontal members 5 at different elevations. In this example, the horizontal members 5 are uniform logs. Members 5 are parallel to the sides of the squares defined by the positions of the upright members. The horizontal members 5 are arranged in mutually perpendicular sets, for example members 5*a* and 5*b* connected to the single upright member 3*d*.

Figure 2:
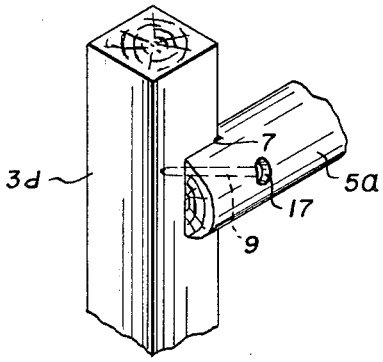
FIG. 2 is a perspective view of an upright member, a horizontal member and the connection therebetween of the structure of FIG. 1.
Figure 3:
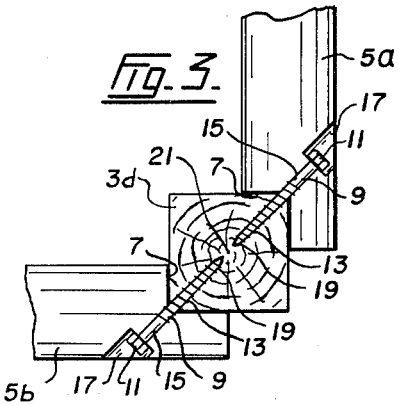
FIG. 3 is a sectional view showing the members and connection of FIG. 2 in plan.

The horizontal members are connected to the upright members in the manner exemplified by FIGS. 2 and 3. Each of the horizontal members has a right angled notch 7 formed at each end which is shaped to receive one of the upright members, for example, member 3*d*.

As seen, a lag bolt 9 having a head 11 and a threaded opposite end 13 provides means for connecting each of the horizontal members to one of the upright members. Each of the horizontal members has an aperture 15 extending therethrough at an angle of substantially 45° for receiving the shank of the lag bolt 9. There is a countersunk bore 17 on each horizontal member for the head 11 of the lag bolt. The threaded ends 13 of the lag bolts are received in correspondingly tapped apertures 19 extending diagonally into the upright members. As seen best in FIG. 3, the lag bolt connecting each horizontal member, for example, member 5*a*, is connected to an upright member, member 3*b* in the example, by a lag bolt 9 which extends towards the centre 21 of the upright member and in the direction of the adjacent mutually perpendicular horizontal members, for example member 5*b*. This combination of lag bolts and notches provides an extremely rigid framework and a building structure which can be freestanding.

As the lag bolt, or other elongated fastener, is tightened, the two perpendicular faces of the notch of the horizontal member are pulled tightly against the two faces of the corner of the upright member, respectively, creating friction among faces and a firm positioning of the corner of the upright member into the vertex of the notch of the horizontal member, both generating structural strength in the mutual structure.

As seen in FIG. 1, the child's play structure may include such accessories as the ladders 23 and the slide 25, but the structure essentially comprises only three main components, the upright timbers 3, the horizontal logs 5 and the lag bolts 9.

The invention could also be applied to other types of structures such as log cabins, sundecks and free-standing moveable fences. Additionally, the wooden members could be replaced by steel members such as pipes. The horizontal members would have notches shaped to receive pipes and nuts and bolts would replace the lag bolts.

What is claimed is:

1. A building structure comprising: upright members;

mutually perpendicular horizontal members having notches at adjacent ends shaped to receive one said upright member, each notch convering a minor portion of the surface of said upright member so that each horizontal member does not contact a mutually perpendicular horizontal member; and connecting means for connecting each said horizontal member to said one upright member, the connecting means comprising an elongate fastener extending from said each horizontal member into the one upright member in the direction of the perpendicular horizontal members and towards the center of the one upright member, the fastener being at an angle of substantially 45° with said each horizontal member.

2. A building structure as claimed in claim 1 comprising four said upright members arranged at the corners of a rectangle, said horizontal members extending parallel to sides of the rectangle.

3. A building structure as claimed in claim 1 the rectangle comprising a square.

4. A building structure as claimed in claim 3 comprising a plurality of said horizontal members connected to the upright members at different elevations.

5. A building structure as claimed in claim 1, the fasteners comprising lag bolts.

6. A building structure as claimed in claim 1, the upright members being square in section, the notches being right angled.

7. A building structure as claimed in claim 5, each said lag bolt extending through an aperture of said each horizontal member and being threadedly received in an aperture of said one upright member, said each lag bolt having a head adjacent an outer side of said each horizontal member and an end opposite said head which is near the centre of the one upright member.

8. A building structure as claimed in claim 1 or claim 7 comprising a child's play structure with a plurality of said upright members and a plurality of said horizontal members connected thereto.

9. A building structure as claimed in claim 1, the horizontal members comprising elongate wooden cylinders and the upright members comprising squared timbers.

10. A freestanding play structure for children comprising:

upright squared timbers arranged in sets of four said upright members at the corners of a square;

horizontal logs at different elevations extending between the upright members and having right angled notches at each end whereby mutually perpendicular adjacent logs receive one said upright member; and lag bolts for connecting the logs to the upright timbers, each said lag bolt having a head adjacent an outer side of one said log, extending through an aperture of said one log towards the centre of the timber and the adjacent logs perpendicular thereto, and having a threaded portion received in a correspondingly tapped aperture of the one timber.

11. A building structure comprising upright members of squared timbers;

mutually perpendicular, horizontal elongate wooden cylinders having notches at adjacent ends shaped to receive one said upright squared timber;

connecting means for connecting each said horizontal wooden cylinder to said one upright squared timber, the connecting means comprising an elongated fastener extending from said each elongate wooden cylinder into the one squared timber in the direction of the perpendicular, elongate wooden cylinder and towards the center of the one upright squared timber, the fastener being at an angle of substantially 45° with said each horizontal elongate wooden cylinder.

* * * * *